US007825825B2

(12) United States Patent
Park

(10) Patent No.: US 7,825,825 B2
(45) Date of Patent: Nov. 2, 2010

(54) TERMINAL AND COMPUTER PROGRAM PRODUCT FOR RECEIVING TRAFFIC INFORMATION, METHOD OF PROVIDING SIGNAL LIGHT INFORMATION, AND METHOD OF GUIDING SIGNAL

(75) Inventor: Young Jin Park, Pyeongtaek-si (KR)

(73) Assignee: LG Electronics Inc., Seoul (KR)

( * ) Notice: Subject to any disclaimer, the term of this patent is extended or adjusted under 35 U.S.C. 154(b) by 295 days.

(21) Appl. No.: 12/056,968

(22) Filed: Mar. 27, 2008

(65) Prior Publication Data

US 2009/0115632 A1 May 7, 2009

(30) Foreign Application Priority Data

Nov. 1, 2007 (KR) ..... 10-2007-0110812

(51) Int. Cl.
*G08G 1/095* (2006.01)
*G08G 1/00* (2006.01)

(52) U.S. Cl. ..... 340/907; 340/906; 340/915; 340/929; 701/117

(58) Field of Classification Search ..... 340/907, 340/906, 915, 929
See application file for complete search history.

(56) References Cited

U.S. PATENT DOCUMENTS

| | | | | |
|---|---|---|---|---|
| 5,635,920 | A * | 6/1997 | Pogue et al. | 340/901 |
| 6,850,170 | B2 * | 2/2005 | Neff | 340/907 |
| 7,375,650 | B2 * | 5/2008 | Lo | 340/907 |
| 2005/0237224 | A1 * | 10/2005 | Gotfried | 340/929 |
| 2007/0142037 | A1 * | 6/2007 | O'Toole et al. | 455/414.1 |

* cited by examiner

*Primary Examiner*—Donnie L Crosland
(74) *Attorney, Agent, or Firm*—Birch, Stewart, Kolasch & Birch, LLP

(57) ABSTRACT

A terminal and computer program product for receiving traffic information, a method of providing traffic light information, and a method of guiding a signal are provided. The method of providing traffic light information includes receiving a message comprising traffic light information and having a hierarchical structure; acquiring the traffic light information by decoding the message; and displaying signal information of a specific traffic light in a display based on the traffic light information.

21 Claims, 12 Drawing Sheets

TERMINAL AND COMPUTER PROGRAM PRODUCT FOR RECEIVING TRAFFIC INFORMATION, METHOD OF PROVIDING SIGNAL LIGHT INFORMATION, AND METHOD OF GUIDING SIGNAL

CROSS REFERENCE TO RELATED APPLICATIONS

This application claims priority under 35 U.S.C. §119(a) on Patent Application No. 10-2007-0110812 filed in Republic of Korea on Nov. 1, 2007, the entire contents of which are hereby incorporated by reference.

BACKGROUND

1. Field

This document relates to a terminal and computer program product for receiving traffic information, a method of providing traffic light information, and a method of guiding a signal.

2. Related Art

There has been no method of providing traffic information that provides traffic light information.

When a vehicle travels, because traffic light information is not provided to a navigation system, a change of a traffic light can be checked with only the sense of sight of a driver. Accordingly, when the traffic light suddenly changes to a red light, the vehicle should suddenly brake. Further, while driving the vehicle, because the driver should concentrate his attention on the traffic light in order to check a change of the traffic light, it is difficult for the driver to rapidly cope with a change of surrounding situations.

SUMMARY

An aspect of this document is to provide a terminal and computer program product for receiving traffic information and a method of providing traffic light information that can provide a more accurate road situation to a vehicle driver by providing information of traffic Another aspect of this document is to provide a terminal and computer program product for receiving traffic information and a method of guiding a signal that can provide user convenience by guiding signal information of a traffic light with a voice.

In one general aspect, there is a method and computer program product for providing traffic light information that includes: receiving a message comprising traffic light information and having a hierarchical structure; acquiring the traffic light information by decoding the message; and displaying signal information of a specific traffic light in a display based on the traffic light information.

In another aspect, there is a method and computer program product for guiding a signal that includes: receiving a message comprising traffic light information and having a hierarchical structure; acquiring the traffic light information by decoding the message; and outputting an announcement related to a specific traffic light based on the traffic light information.

In another aspect, there is a terminal that includes: a display unit; a broadcasting signal receiver for receiving a message comprising signal light information and having a hierarchical structure; a Transport Protocol Expert Group (TPEG) decoder for acquiring the traffic light information by decoding the message; a processor for providing signal information of a specific traffic light by processing the traffic light information; and a controller for controlling the processor to display the signal information of the specific traffic light in the display unit.

In another aspect, there is a terminal that includes: a voice output unit; a broadcasting signal receiver for receiving a message comprising signal light information and having a hierarchical structure; a TPEG decoder for acquiring the traffic light information by decoding the message; a processor for providing signal information of a specific traffic light by processing the traffic light information; and a controller for controlling the processor to output an announcement related to the specific traffic light through the voice output unit.

BRIEF DESCRIPTION OF THE DRAWINGS

The details of one or more implementations are set forth in the accompanying drawings and the description below. In the entire description of this document, like reference numerals represent corresponding parts throughout various figures.

DETAILED DESCRIPTION

Hereinafter, implementations will be described in detail with reference to the accompanying drawings.

Figure 1:
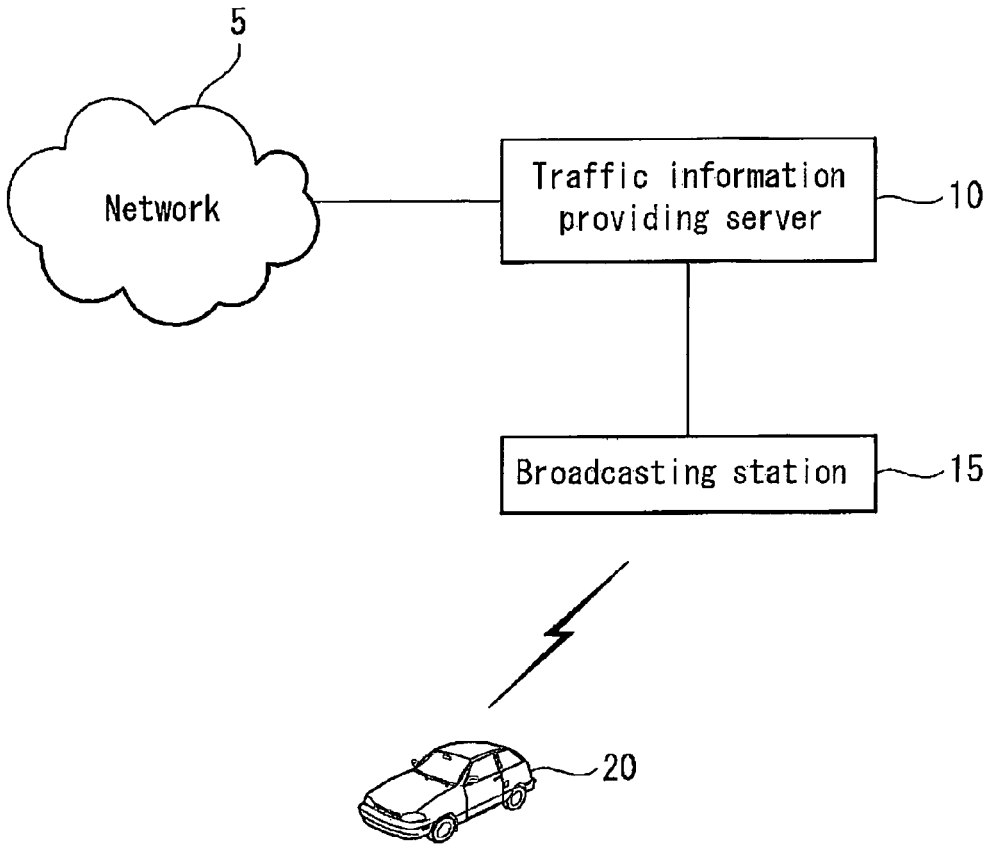
FIG. 1 is a diagram illustrating a configuration of a traffic information providing system for providing traffic light information in an implementation.

FIG. 1 is a diagram illustrating a configuration of a traffic information providing system for providing traffic light information in an implementation.

Referring to FIG. 1, the traffic information providing system includes a network 5, a traffic information providing server 10, a broadcasting station 15, and a vehicle 20.

The network 5 includes a wired/wireless communication network such as a Local Area Network (LAN) and a Wide Area Network (WAN). Various traffic information (e.g. road traffic information and interest region information) including traffic light information is collected through the network 5, and the collected information is processed according to a TPEG standard in the traffic information providing server 10 and is transmitted to the broadcasting station 15. Accordingly, the broadcasting station 15 inserts traffic information including the traffic light information into a broadcasting signal and broadcasts the broadcasting signal to the vehicle 20.

The traffic information providing server 10 reconstitutes various traffic information collected from several paths connected to the network 5, for example input of an operator, wired/wireless Internet, a digital broadcasting service such as a Transparent Data Channel (TDC) and a Multimedia Object Transfer (MOT), and other servers or a probe car into a traffic information format such as a format according to for example, a TPEG standard, which is a standard for a traffic information service and transmits the traffic information format to the broadcasting station 15.

In more detail, in the implementation, the traffic information providing server 10 generates traffic information in a format of a TPEG standard including traffic light information and transmits the traffic information format to the broadcasting station 15.

The broadcasting station 15 inserts traffic information including traffic light information received from the traffic information providing server 10 into a broadcasting signal and transmits the broadcasting signal so that a terminal for receiving traffic information, e.g. a navigation device mounted in the vehicle 20 may receive traffic information.

The traffic information includes traffic light information and may include information about various traffic conditions required for land transportation, marine transportation, and air transportation such as an accident, a road situation, traffic congestion, road building, road closure, delay of a public traffic network, and delay of an airline service.

The broadcasting station 15 receives traffic information including the traffic light information and transmits the traffic information to the vehicle 20 through a digital signal according to various digital broadcasting standards. In this case, a broadcasting standard includes various digital broadcasting standards such as an European digital audio broadcasting (DAB) standard based on Yureka-147 [ETSI EN 300 401], a terrestrial or satellite digital multimedia broadcasting (DMB) standard, a terrestrial digital video broadcasting (DVB-T) standard, a mobile digital video broadcasting-handheld (DVB-H) standard, and a media forward link only (MFLO) standard.

Further, the broadcasting station 15 can transmit traffic information including traffic light information through a wired/wireless network such as wired/wireless Internet.

The vehicle 20 represents all carriers using a mechanical or electronic device for transporting a person or goods, such as a car, bus, train, ship, and aircraft. In this specification, a terminal for receiving traffic information mounted in a general car is described, however this document is not limited thereto.

The terminal for receiving traffic information is mounted in the vehicle 20, receives traffic light information from the broadcasting station 15 using the mounted terminal for receiving traffic information, processes the traffic light information, and delivers the processed traffic light information to the user through a graphic, a text and/or audio.

Figure 2:
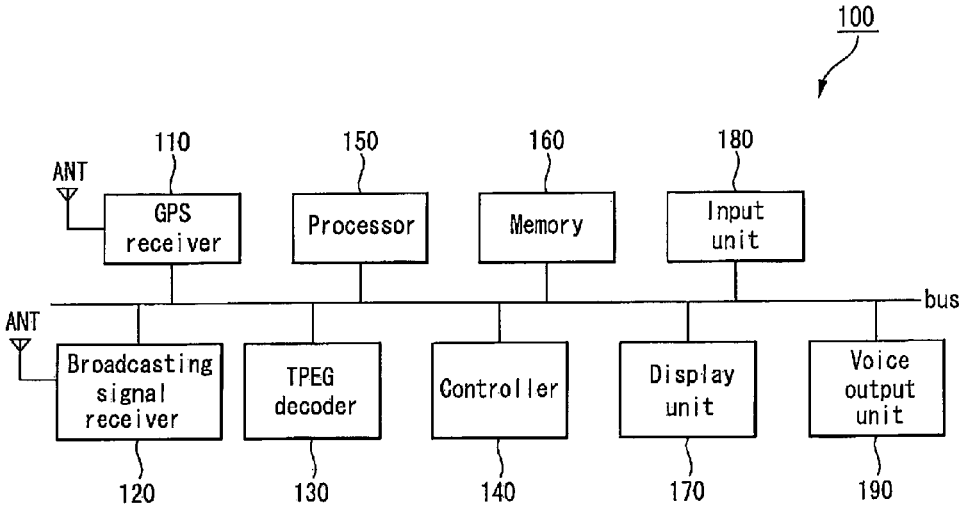
FIG. 2 is a block diagram illustrating a configuration of a terminal for receiving traffic information in an implementation.

FIG. 2 is a block diagram illustrating a configuration of a terminal for receiving traffic information in an implementation.

The traffic information reception terminal 100 is classified into an in-dash type traffic information reception terminal and an on-dash type traffic information reception terminal according to a form provided in the vehicle 20. The in-dash type traffic information reception terminal is inserted into and is fixedly mounted in a predetermined space allocated within a dashboard of the vehicle 20. The on-dash type traffic information reception terminal is provided on a dashboard of the vehicle 20 or using a predetermined support thereabout and because it can be detached from the vehicle 20, it is called a portable navigation device.

The traffic information reception terminal 100 in this implementation includes the in-dash type traffic information reception terminal and the on-dash type traffic information reception terminal and may include information processing devices for receiving and/or processing traffic information, such as various mobile terminals that can perform a navigation function by interlocking with a Global Positioning System (GPS) receiver for receiving a navigation message transmitted from a GPS satellite within the vehicle 20.

Referring to FIG. 2, the traffic information reception terminal 100 includes a GPS receiver 110, a broadcasting signal receiver 120, a TPEG decoder 130, a controller 140, a processor 150, a memory 160, a display unit 170, an input unit 180, and a voice output unit 190.

The GPS receiver 110 receives GPS data, which are a position information signal transmitted from the GPS satellite (not shown) or other terrestrial or satellite navigation systems through an antenna ANT. The traffic information reception terminal 100 can check a current position of the vehicle 20 through the GPS data.

The broadcasting signal receiver 120 receives a broadcasting signal including traffic information of a TPEG format from the broadcasting station 15 through the antenna ANT. As described above, the traffic information includes traffic light information.

A broadcasting signal received in the broadcasting signal receiver 120 includes video and audio data according to various standards such as terrestrial or satellite digital multimedia broadcasting (DMB), digital audio broadcasting (DAB), and digital video broadcasting (DVB-T and DVB-H), traffic information according to a traffic information (TPEG) service and a Binary Format for Scene (BIFS) data service, and additional information such as various additional data. Further, the broadcasting signal receiver 120 tunes a signal band provided by traffic information, demodulates the turned signal, and outputs the signal to the TPEG decoder 130.

The TPEG decoder 130 decodes traffic information of a TPEG format and provides various information and traffic light information comprised in the traffic information to the controller 140.

The controller 140 controls general operations of the traffic information reception terminal 100. The processor 150 processes various data by the control of the controller 140 and outputs the processed result to the display unit 170 or the voice output unit 190. The controller 140 and the processor 150 can be embodied as a Control Processing Unit (CPU).

The memory 160 includes a non-volatile memory for storing a program and data required for performing various functions provided in the traffic information reception terminal 100 and a volatile memory for temporarily storing various data generated according to an operation of the traffic information reception terminal 100. In this implementation, the memory 160 stores a navigation program, digital map data, and various icons for guiding a travel of the vehicle 20.

The display unit 170 uses a display device such as a Liquid Crystal Display (LCD) and displays a video signal provided from the processor 150. Further, the display unit 170 may simultaneously perform a display function of displaying various functions provided by the traffic information reception terminal 100 in a menu structure and an input function of executing a selected menu by a touch using a user finger or a stylus pen.

The input unit 180 receives various operation instructions from the user and transmits the operation instructions to the controller 140. The input unit 180 may use a key button, a remote controller, a touch pad, and a touch screen.

The voice output unit 190 generates an audio signal for a voice guide for the selected route by the control of the controller 140, amplifies the audio signal to a preset level, and outputs the audio signal through a speaker SPK. In this implementation, the voice output unit 190 outputs a signal guide based on traffic light information with a voice by the control of the controller 140.

Figure 3:
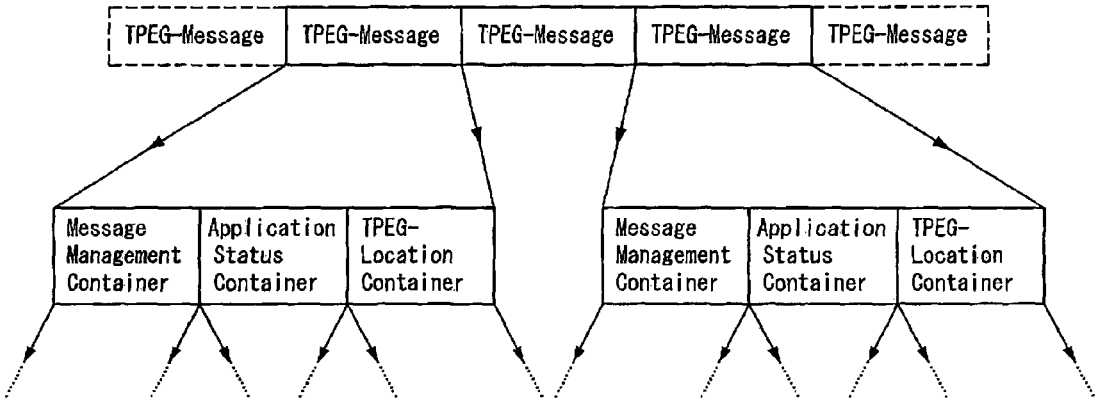
FIG. 3 is a diagram illustrating a format of TPEG information in an implementation.

FIG. 3 is a diagram illustrating a format of TPEG information in an implementation.

Referring to FIG. 3, the TPEG information includes a sequence of a message segment (hereinafter, referred to as a 'TPEG message').

The message segments can be applied to different applications. As an example, each TPEG message can be applied to one of a TPEG-Congestion and Travel-Time information Application (TPEG-CTT), a TPEG-road traffic message application, a TPEG-public transport information application, a TPEG-multimedia based traffic and travel information application, and other applications. In this implementation, traffic light information can be applied to one of the above-described applications.

An intrinsic identification number called an Application Identification (AID) is allocated to each TPEG application. The AID is used to decode the received TPEG message using the most suitable application decoder.

An identification 0001 (hex) is allocated to the TPEG-road traffic message application, an application identification 0010 (hex) is allocated to the TPEG-CTT, and an application identification 0008 (hex) is allocated to the TPEG-multimedia based traffic and travel information application.

The TPEG message includes a message management container, an application state container, and a TPEG-location container.

The application state container has a different content according to a kind of the TPEG message applications. Traffic light information in this implementation is comprised in the application state container and is transmitted. As an example, when the TPEG message is applied to the TPEG-CTT application, the traffic light information is comprised in a TPEG-CTT container, which is an application state container and is transmitted.

In this case, the TPEG-CTT container may include congestion and travel time status information, prediction information of a congestion and travel time status, addition information, and traffic light information in the implementation.

The congestion and travel time status information includes information about an average link speed, a link travel time, link delay, and a congestion type.

The prediction information of a congestion and travel time status includes information about a prediction of an average link speed, a prediction of a link travel time, and a congestion tendency.

The addition information describes additional information or auxiliary information related to the congestion and travel time status information in a text form.

The traffic light information includes a traffic light number, a traffic light period, a signal of a traffic light at an acquisition time point of the traffic light information, an elapsed time period from a time point changed to the corresponding signal to the acquisition time point of the traffic light information, additional information, and information about the acquisition time point of the traffic light information. This is described in detail in FIG. 4.

The TPEG location container includes position information about a link, which is each road section. Messages comprised in TPEG information are dependent on a position, and each message includes information about a position.

Figure 4:
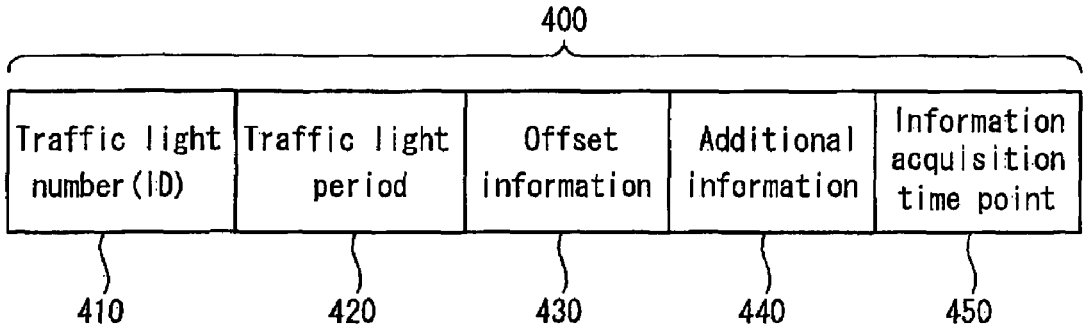
FIG. 4 is a diagram illustrating traffic light information in an implementation.

FIG. 4 is a diagram illustrating traffic light information comprised in the application state container of FIG. 3.

Referring to FIG. 4, traffic light information 400 includes a traffic light number 410, a traffic light period 420, offset information 430, additional information 440, and an information acquisition time point 450.

The traffic light number 410 indicates the identification (ID) of a traffic light to identify traffic lights provided at each road section. In the TPEG, a link ID is allocated to each road section, and a traffic light ID may be allocated by interlocking with the link ID. For example, when three traffic lights are provided at a road section in which the link ID is '100', the numbers of the traffic lights are defined as '100a', '100b', and '100c'. This is an example, and the traffic light number may be defined with other methods.

The traffic light period 420 indicates a time period in which the traffic light sustains a current signal state. For example, when the traffic light consists of a green light, a yellow light, and a red light, a period of the green light may be 1 minute, a period of the yellow light may be 5 seconds, and a period of the red light may be 30 seconds.

That is, when a time period of 1 minute has elapsed from a time point changed to the green light, the green light may be changed to the yellow light, and when a time period of 5 seconds has elapsed from a time point changed to the yellow light, the yellow light may be changed to the red light.

The offset information 430 includes information about a signal of a traffic light at an acquisition time point of the signal light information and an elapsed time period from a time point changed to the corresponding signal to the acquisition time point of the traffic light information. For example, the offset information 430 may include information in which a traffic light 'B' is currently a red light and a time period of 30 seconds has elapsed after being changed to a red light.

The additional information 440 includes information about turning on/off or a failure of the traffic light and use of a variable road. A variable road is a road having characteristics that vary, therefore affecting traffic flow (e.g., time-specific High Occupancy Vehicle (HOV) restrictions, time-specific bus-only restrictions, etc.). Variable roads also include roads subject to periodic or aperiodic closure for certain purposes (such as for parades, celebrations, political demonstrations, or government motorcades) or roads that allow traffic to flow in one direction at one time of day or on a particular day, and traffic to flow in another direction at another time or day.

The information acquisition time point 450 includes information about an acquisition time point of the traffic light information, i.e. a current traffic light number 410, a traffic light period 420, offset information 430, and additional information 440.

Figure 5:
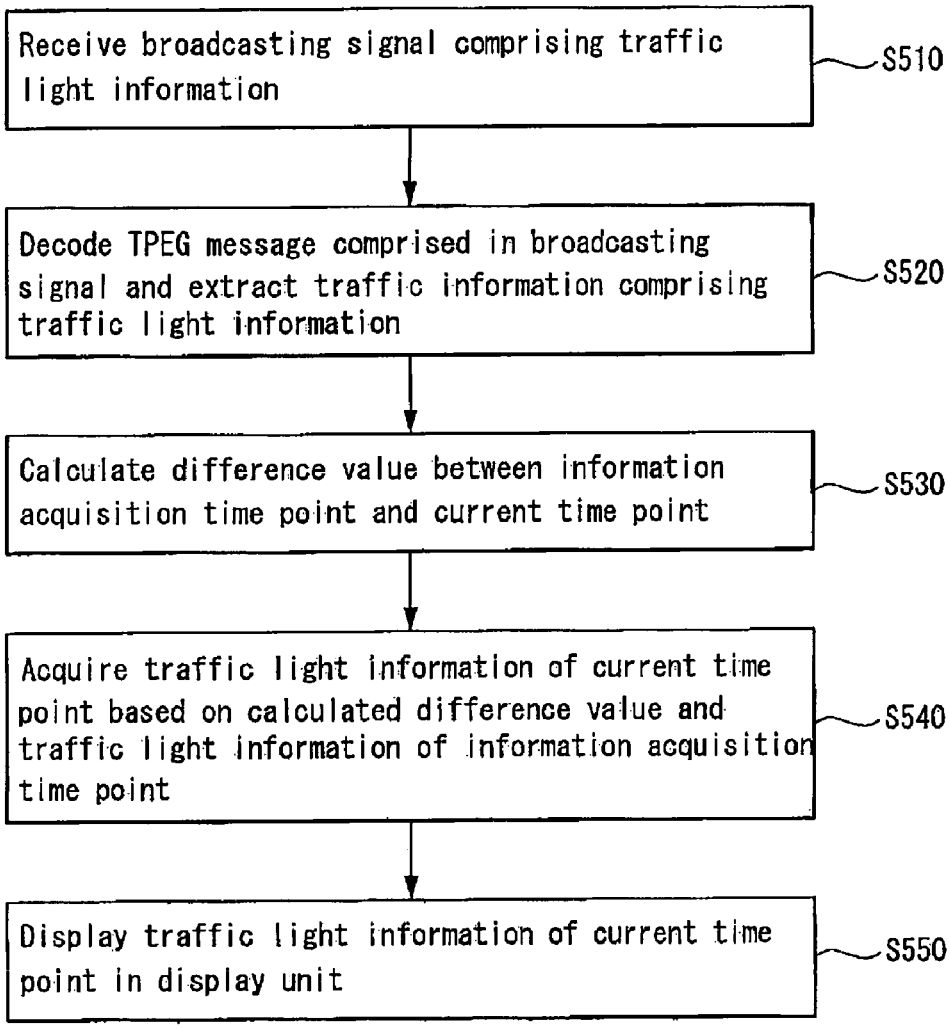
FIG. 5 is a flowchart illustrating a method of providing traffic light information in an implementation.

FIG. 5 is a flowchart illustrating a method of providing traffic light information in an implementation.

Referring to FIG. 5, the broadcasting signal receiver 120 of the traffic information reception terminal 100 receives a broadcasting signal including traffic light information from the broadcasting station 15 (S510). As described above, the broadcasting signal includes a TPEG message shown in FIG. 3, the traffic light information may be comprised in an application state container of the TPEG message.

The TPEG decoder 130 decodes a TPEG message comprised in the broadcasting signal and extracts various traffic information including the traffic light information 400 comprised in the TPEG message (S520). As shown in FIG. 4, the traffic light information 400 includes a traffic light number 410, a traffic light period 420, offset information 430, additional information 440, and information about an information acquisition time point 450.

The processor 150 calculates a difference value between the information acquisition time point 450 of the traffic light information 400 and a current time point by the control of the controller 140 (S530).

The controller 140 acquires traffic light information of a current time point based on the calculated difference value and traffic light information of the information acquisition time point (S540).

Figure 6:
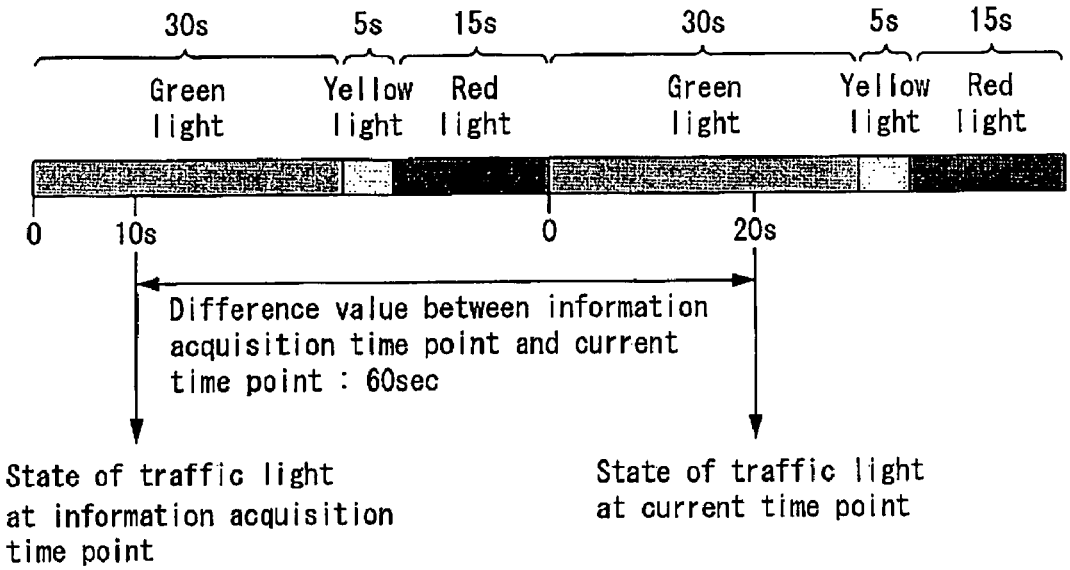
FIG. 6 is a diagram illustrating an example of acquiring traffic light information of a current time point.

FIG. 6 is a diagram illustrating an example of acquiring traffic light information of a current time point.

Referring to FIG. 6, a process of acquiring traffic light information of a current time point is described in detail.

Referring to FIG. 6, it is assumed that a period of a green light is 30 seconds, a period of a yellow light is 5 seconds, and a period of a red light is 15 seconds. The period information can he checked from the traffic light period 420 shown in FIG. 4. A state of a traffic light at an information acquisition time point is a state in which 10 seconds has elapsed after being changed to a green light and this information can be checked from the offset information 430 shown in FIG. 4.

Further, when the difference value between the information acquisition time point calculated at step S530 and a current time point is 60 seconds, a state of a traffic light at a current time point is a state in which 20 seconds has elapsed after being changed to a green light, as shown in FIG. 6. That is, a traffic light state at a current time point can be checked by delaying a time corresponding to the difference value calculated at step S530 from the information acquisition time point.

When traffic light information of a current time point is acquired with this method, the controller 140 controls the processor 150 to display traffic light information of a current time point in the display unit 170 (S550).

Figure 7:
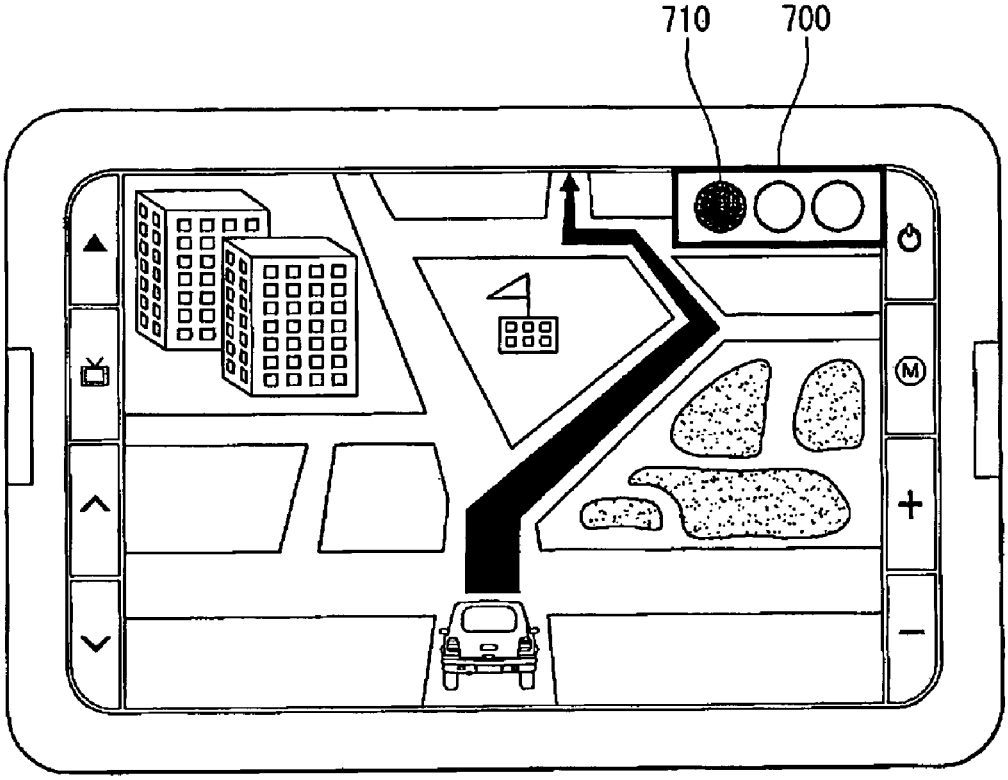
FIGS. 7 and 8 illustrate examples of displaying traffic light information in a display unit in an implementation.
Figure 8:
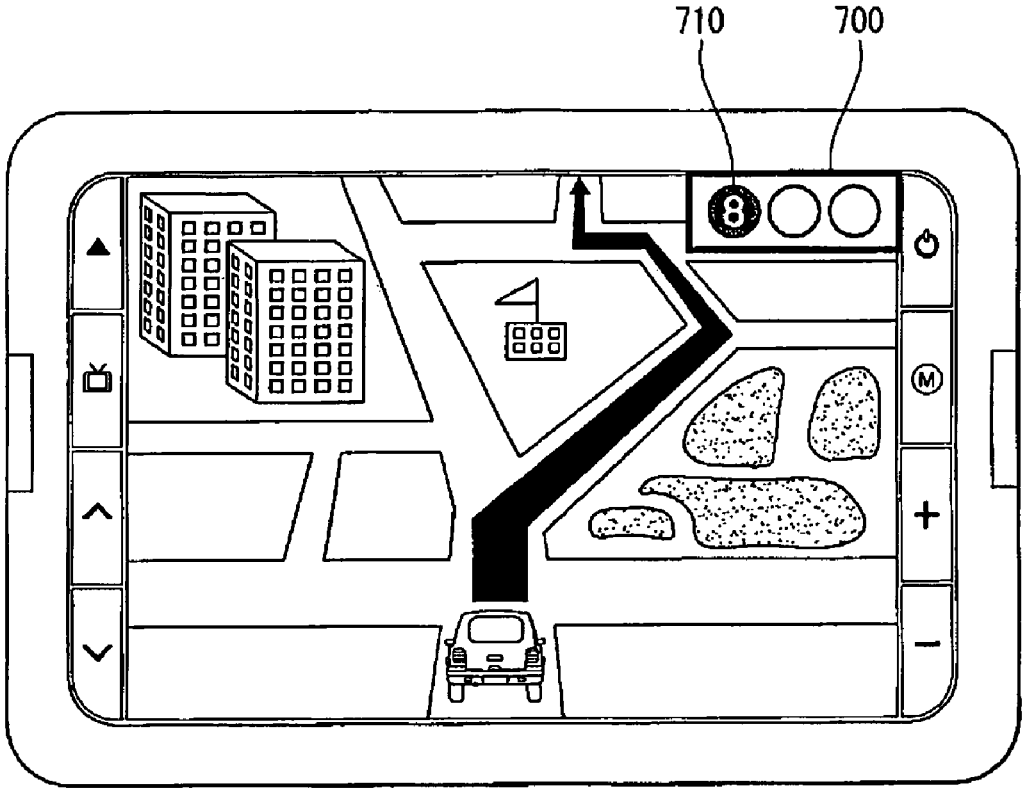

FIGS. 7 and 8 illustrate examples of displaying traffic light information in a display unit in an implementation.

Referring to FIG. 7, at a road section where the vehicle 20 is currently positioned, information 700 of a traffic light in which the vehicle 20 is to be reached is displayed at a right upper end of the display unit 170. In FIG. 7, because a red light 710 is turned on, a driver should wait until the red light 710 is changed to a green light.

Referring to FIG. 8, a count number, which is time information in which a current signal is to be changed may be displayed in addition to the traffic light information 700. In FIG. 8, the red light 710 is turned on and a count number '8' is displayed within the red light 710, and this indicates that after 8 seconds, the red light 710 is changed to another light. The count number decreases by 1 in every second, and is displayed to '0' at a time point in which the signal is changed. That is, the user can easily check a change time point of the light signal through the count number and rapidly cope with the signal change.

Figure 9:
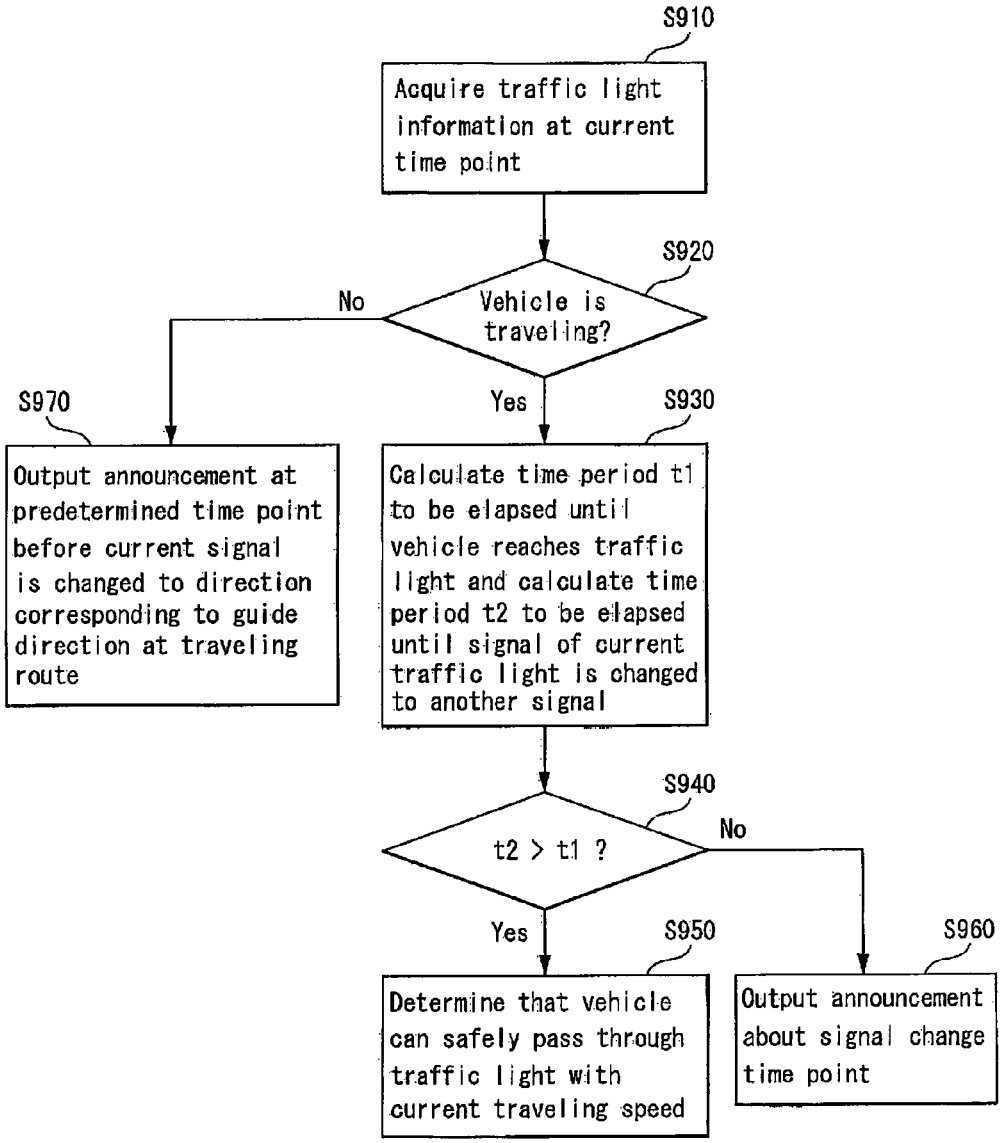
FIG. 9 is a flowchart illustrating a method of guiding a travel of a vehicle using traffic light information in an implementation.

FIG. 9 is a flowchart illustrating a method of guiding travel of a vehicle using traffic light information in an implementation.

In this implementation, the traffic light information is comprised in a TPEG-CTT message and is transmitted.

Referring to FIG. 9, the traffic information reception terminal 100 acquires traffic light information of a current time point with a method described in FIG. 6 (S910).

The controller 140 determines whether the vehicle 20 is traveling (S920). Whether the vehicle 20 is traveling can be determined from GPS data that are input through the UPS receiver 110 or data that are input from a vehicle speed sensor (not shown) for providing average speed information of the vehicle 20.

If the vehicle 20 is traveling (S920: Yes), the controller 140 controls the processor 150 to calculate a time period t1 to be elapsed until the vehicle 20 reaches a traffic light from a current time point and to calculate a time period t2 to be elapsed until a current signal of a traffic light is changed to another signal from a current time point (S930).

Here, the time period t1 to be elapsed until the vehicle 20 reaches the traffic light can be calculated using information such as an average speed, an average link speed, and a link travel time of the vehicle 20. The average speed of the vehicle 20 can be checked from data provided from a vehicle speed sensor (not shown), and the average link speed or the link travel time can be checked from congestion and travel time state information comprised in the TEPG-CTT container.

The controller 140 determines whether the time period t2 to be elapsed until a current signal of the traffic light is changed to another signal is greater than the time period t1 to be elapsed until the vehicle 20 reaches the traffic light (S940). If the time period t2 to be elapsed until a current signal of the traffic light is changed to another signal is greater than the time period t1 to be elapsed until the vehicle 20 reaches the traffic light (S940: Yes), the controller 140 determines that the vehicle 20 can safely pass through the traffic light with a current traveling speed (S950).

If the time period t2 to be elapsed until a current signal of the traffic light is changed to another signal is not greater than the time period t1 to be elapsed until the vehicle 20 reaches the traffic light (S940: No), the controller 140 controls the processor 150 to output an announcement about a change time point of a traffic signal to the voice output unit 190 (S960). In more detail, if the time period t2 to be elapsed until a current signal of the traffic light is changed to another signal is not greater than the time period t1 to be elapsed until the vehicle 20 reaches the traffic light, the controller 140 determines that the vehicle 20 cannot safely pass through the traffic light and outputs an announcement about a signal change in a predetermined time period before a signal of the traffic light is changed.

Figure 10:
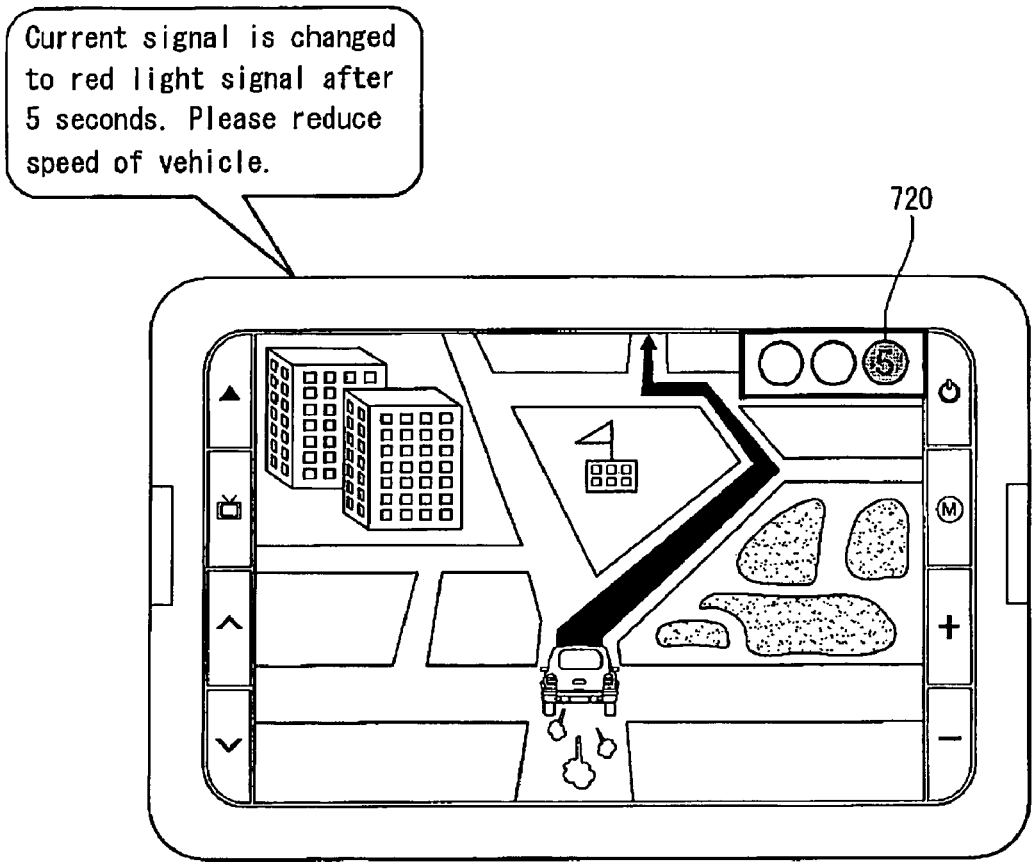
FIGS. 10 to 12 are screens illustrating a voice guide about a signal change in an implementation.
Figure 11:
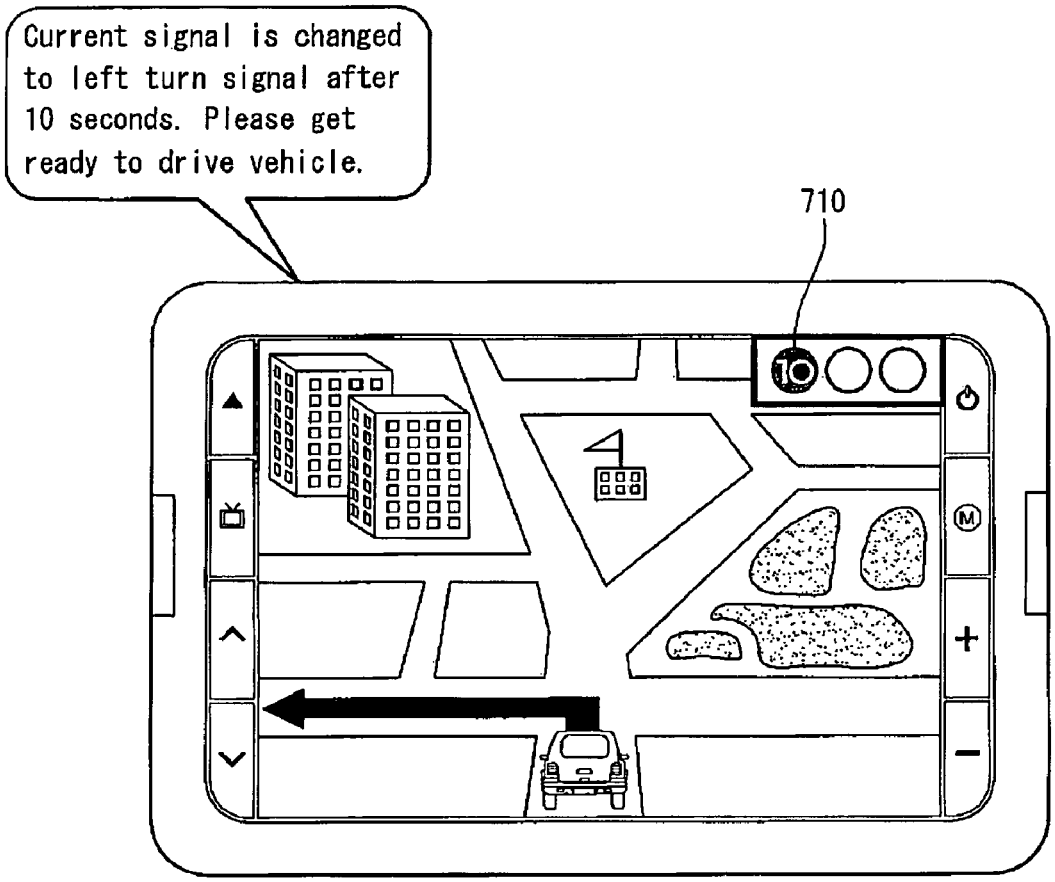
Figure 12:
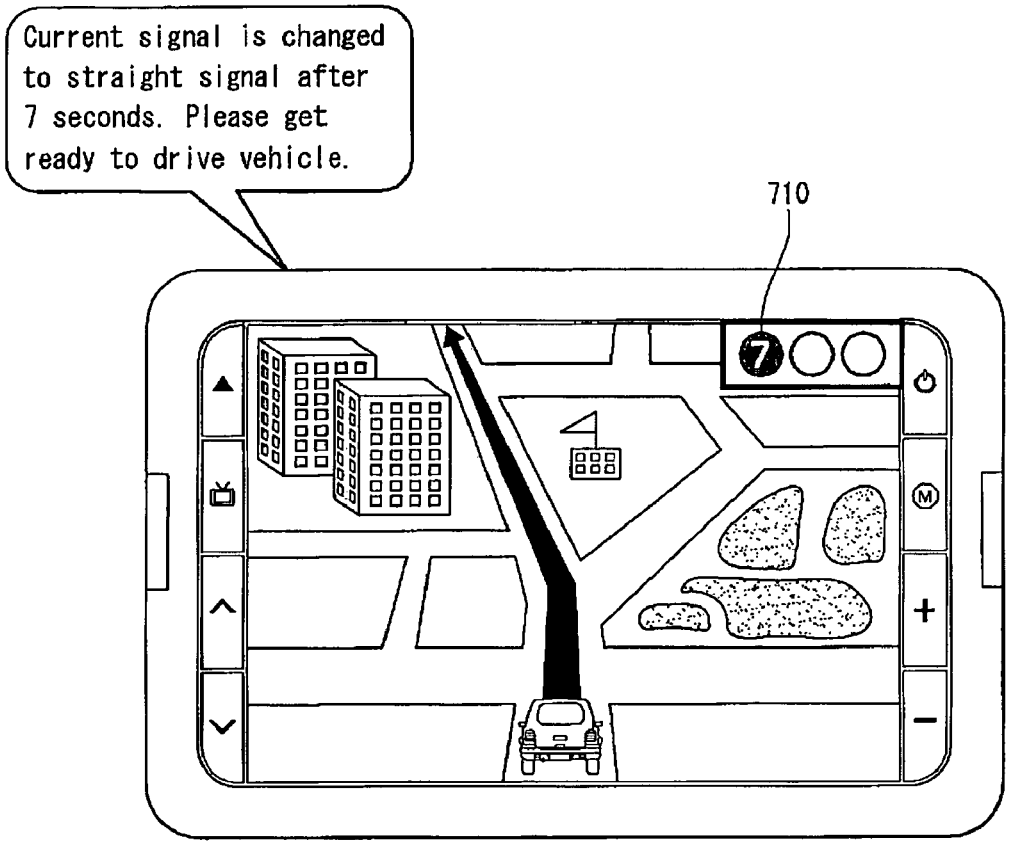

FIGS. 10 to 12 show screens illustrating a voice guide for a signal change.

Referring to FIG. 10, although a traffic light in which the traveling vehicle 20 is to be reached is currently a green light 720, in consideration of an average speed of the vehicle 20, when it is determined that the vehicle 20 cannot pass through the green light 720, the controller 140 controls the voice output unit 190 to output an announcement such as "A current signal is changed to a red light after 5 seconds. Please reduce a speed of a vehicle."

If the vehicle 20 is not traveling at step S920, the controller 140 determines whether the vehicle 20 stops. If the vehicle 20 stops (S920: No), the controller 140 controls the processor 150 to output an announcement through the voice output unit 190 in a predetermined time period before a signal is changed to a direction corresponding to a guide direction of a traveling route (S970).

Referring to FIGS. 11 and 12, the vehicle 20 is in a stop state at an intersection due to the red light 710.

In FIG. 11, the controller 140 controls the voice output unit 190 to output an announcement such as "A current signal is changed to a left turn signal after 10 seconds. Please get ready to drive a vehicle." before a predetermined time period, for example at 10 seconds before a red signal is changed to a left turn signal, which is a signal of a direction corresponding to a left direction, which is a guide direction at a traveling route.

Further, in FIG. 12, the controller 140 controls the voice output unit 190 to output an announcement such as "A current signal is changed to a straight signal after 7 seconds. Please get ready to drive a vehicle." before a predetermined time period, for example at 7 seconds before a red signal is changed to a straight signal, which is a signal of a direction corresponding to a straight direction, which is a guide direction at a traveling route.

In the above-described implementation, traffic light information is comprised in a CTT container of a TPEG-CTT message and is transmitted, however the traffic light information may be comprised in other TPEG applications and be transmitted.

In an implementation, a vehicle driver can receive a voice guide about current signal information and a light signal change of a signal light positioned at each road section. Accordingly, the vehicle driver can efficiently drive the vehicle.

Throughout the preceding description, the term traffic light has been identified as a traffic signal. However, other traffic signal indicators are also within the scope of the invention.

Other features will be apparent from the description and drawings, and from the claims.

What is claimed is:

1. A method of processing traffic information in a motor vehicle, comprising:

receiving, in the motor vehicle, a message comprising traffic information and having a hierarchical structure;

acquiring the traffic information by decoding the message by the motor vehicle; and displaying, in the motor vehicle, specific traffic light information in a display based on the decoded traffic information, wherein the specific traffic light information includes information about power to the specific traffic light being turned on or off.

2. The method of claim 1, wherein the step of receiving the message comprises receiving a broadcasting signal, and the message is a Transport Protocol Expert Group (TPEG) message comprising a message management container, an application state container, and a location container.

3. The method of claim 1, wherein the specific traffic light information comprises one of:

information about a failure of the specific traffic light;

information about a light number of the specific traffic light;

information about a light period of the specific traffic light;

information about a light information acquisition time point of the specific traffic light;

information about a light signal of the specific traffic light at the traffic light information acquisition time point; and information about an elapsed time period from a time point changed to a corresponding signal to the traffic light information acquisition time point.

4. The method of claim 3, wherein the traffic information further comprises:

variable road use information including one of High Occupancy Vehicle (HOV) time information, traffic direction time restrictions, and a predetermined time-based road restriction, the method further comprising displaying the variable road use information.

5. The method of claim 1, wherein the step of displaying the specific traffic light information comprises:

counting down and displaying a remaining time period until a signal of the specific traffic light is changed.

6. A method of processing a traffic signal in a motor vehicle, comprising:

receiving, by the motor vehicle, a message comprising traffic information and having a hierarchical structure;

acquiring the traffic information by decoding the message by the motor vehicle; and outputting an announcement in the motor vehicle related to a specific traffic light, wherein the announcement includes information about power to the specific traffic light being turned on or off.

7. The method of claim 6, wherein the step of receiving the message comprises receiving a broadcasting signal, and the message is a TPEG message comprising a message management container, an application state container, and a location container.

8. The method of claim 6, wherein the announcement comprises one of:

information about a failure of the specific traffic light;

information about a light number of the specific traffic light;

information about a light period of the specific traffic light;

information about a light information acquisition time point of the specific traffic light;

information about a signal of the specific traffic light at the traffic light information acquisition time point; and information about an elapsed time period from a time point changed to a corresponding signal to the traffic light information acquisition time point.

9. The method of claim 6, wherein the step of outputting of an announcement related to a specific traffic light comprises outputting, when a vehicle is traveling, an announcement related to the specific traffic light in a predetermined time period before the traveling vehicle passes through the specific traffic light.

10. The method of claim 6, wherein step of the outputting of an announcement related to a specific traffic light comprises outputting, when a vehicles stops, an announcement related to the specific traffic light in a predetermined time period before a signal of the specific traffic light is changed to a signal corresponding to a traveling route of the stopped vehicle.

11. A terminal, comprising:

a display unit;

a broadcasting signal receiver configured to receive a message comprising traffic information and having a hierarchical structure;

a TPEG decoder configured to acquire the traffic light information by decoding the message;

a processor configured to provide specific traffic light information by processing the traffic information; and a controller configured to control the processor to display the specific traffic light information in the display unit, wherein the specific traffic light information includes information about power to the specific traffic light being turned on or off.

12. The terminal of claim 11, wherein the message is contained in a broadcasting signal, and the message is a TPEG message comprising a message management container, an application state container, and a location container.

13. The terminal of claim 11, wherein the specific traffic light information comprises one of:

information about a failure of the specific traffic light;

information about a light number of the specific traffic light;

information about a light period of the specific traffic light;

information about a light information acquisition time point of the specific traffic light;

information about the specific traffic light at the traffic light information acquisition time point; and information about an elapsed time period from a time point changed to the corresponding signal to the traffic light information acquisition time point.

14. The terminal of claim 13, wherein the traffic information further comprises:

variable road use information including one of High Occupancy Vehicle (HOV) time information, traffic direction time restrictions, and a predetermined time-based road restriction, wherein the controller is further configured to control the processor to display the variable road use information.

15. The terminal of claim 11, wherein the controller is configured to control the display unit to count down and display a remaining time period until a signal of the specific traffic light is changed.

16. A terminal, comprising:

a voice output unit;

a broadcasting signal receiver configured to receive a message comprising traffic light information and having a hierarchical structure;

a TPEG decoder configured to acquire the traffic information by decoding the message;

a processor configured to provide specific traffic light information by processing the traffic information; and a controller configured to control the processor to output an announcement related to the specific traffic light through the voice output unit, wherein the announcement includes information about power to the specific traffic light being turned on or off.

17. The terminal of claim 16, further comprising a display unit configured to display information of the specific traffic light.

18. The terminal of claim 16, wherein the message is contained in a broadcasting signal, and the message is a TPEG message comprising a message management container, an application state container, and a location container.

19. The terminal of claim 16, wherein the announcement comprises one of:

information about a failure of the specific traffic light;

information about a light number of the specific traffic light;

information about a light period of the specific traffic light;

information about a traffic light information acquisition time point of the specific traffic light;

information about a signal of the specific traffic light at the traffic light information acquisition time point; and information about an elapsed time period from a time point changed to the corresponding signal to the traffic light information acquisition time point.

20. The terminal of claim 16, wherein the controller is configured to control, when a vehicle is traveling, the processor and the voice output unit to output an announcement related to the specific traffic light in a predetermined time period before the traveling vehicle passes through a specific traffic light.

21. The terminal of claim 16, wherein the controller is configured to control, when a vehicle stops, the processor and the voice output unit to output an announcement related to the specific traffic light in a predetermined time period before a signal of the specific traffic light is changed to a signal corresponding to a traveling route of the stopped vehicle.

* * * * *